United States Patent [19]

Goltsos

[11] 4,013,798

[45] Mar. 22, 1977

[54] SELECTIVELY VENTABLE FOOD PACKAGE AND MICRO-WAVE SHIELDING DEVICE

[75] Inventor: Costas E. Goltsos, Weston, Mass.

[73] Assignee: Teckton, Inc., Wellesley, Mass.

[22] Filed: Dec. 24, 1975

[21] Appl. No.: 644,163

Related U.S. Application Data

[63] Continuation of Ser. No. 417,905, Nov. 21, 1973, abandoned.

[52] U.S. Cl. ..... 426/107; 219/10.55 D; 219/10.55 E; 220/20.5; 220/22; 229/9; 229/19; 229/DIG. 14; 426/114; 426/118; 426/234

[51] Int. Cl.[2] ..... B65B 25/22

[58] Field of Search ..... 426/106, 107, 113, 114, 426/118, 120, 122, 389, 392, 394, 395, 396, 234, 243, 410, 412, 129; 220/44 A, 20.5, 44 R, 20, 22; 229/2.5, 40, 9, 19, DIG. 14; 206/45.31; 219/10.55 D, 10.55 E

[56] References Cited

UNITED STATES PATENTS

| | | | |
|---|---|---|---|
| 2,714,070 | 7/1955 | Welch | 426/234 |
| 2,878,128 | 3/1959 | Jorgenson | 426/126 X |
| 3,188,215 | 6/1965 | Snow, Jr. | 426/114 |
| 3,228,776 | 1/1966 | Savage et al. | 426/114 |
| 3,271,169 | 9/1966 | Baker et al. | 426/114 |
| 3,547,661 | 12/1970 | Stevenson | 426/243 |
| 3,601,277 | 8/1971 | Andrews | 229/2.5 |
| 3,608,770 | 9/1971 | Naimoli | 229/3.5 MF |
| 3,637,132 | 1/1972 | Gray | 229/53 |
| 3,650,378 | 3/1972 | Kakivchi et al. | 206/387 |
| 3,659,584 | 5/1972 | Doyle | D44/1 F |
| 3,665,491 | 5/1972 | Cooper | 219/10.55 E |
| 3,667,452 | 6/1972 | Brebant | 229/3.5 MF |
| 3,835,281 | 9/1974 | Mannix | 219/10.55 E |
| 3,854,023 | 12/1974 | Levinson | 426/107 X |
| 3,873,735 | 5/1971 | Chalin et al. | 426/114 |
| 3,935,415 | 1/1976 | Moore | 219/10.55 E |

*Primary Examiner*—Steven L. Weinstein
*Attorney, Agent, or Firm*—Wolf, Greenfield & Sacks

[57] ABSTRACT

A frozen or refrigerated precooked meal formed from a number of food components is packaged in a compartmented tray which is transparent to radiant energy such as that from microwave or infrared energy sources. Each of the tray compartments is defined by ridges and side walls formed integrally with the tray and the different component foods of the meal are disposed within selected different tray compartments. A radiation transparent film is secured over the tray and is bonded to the upper edge of the tray side wall and ridges to seal each compartment. Selected areas of the seals between the film and portions of the ridges and/or tray side walls are weakened so that they may rupture in response to excessive water vapor pressure build up to enable the water vapor to escape. The sealed food tray may be placed in a specially formed shielding box which controls the quantity of radiation to which each of the food components are exposed within a given time.

6 Claims, 7 Drawing Figures

SELECTIVELY VENTABLE FOOD PACKAGE AND MICRO-WAVE SHIELDING DEVICE

This is a continuation of application Ser. No. 417,905, filed Nov. 21, 1973, now abandoned.

BACKGROUND OF THE INVENTION

This invention relates to improvements in recently developed radiant energy cooking techniques which enable a complete meal made from a plurality of component foods and packaged in a single compartmented tray to be cooked simultaneously in a radiant energy oven and in which the degree of heating of each of the foods is carefully controlled so that the foods may be selectively heated to their respective intended serving temperatures. In order to cook the food to the most palatable condition it is often desirable to prevent moisture from one of the food components to be exposed to other food components in the package tray. While this may be achieved by covering the tray with a radiation transparent film and sealing that film to the tray ridges and side wall which define the food compartments, there may be some instances in which water vapor in one or more of the compartments reaches a pressure which might break a portion of the seal between compartments which would expose the other food or foods to the water vapor and, perhaps, cause some sogginess in the consistency of some of the component foods. It is among the primary objects of this invention to provide an improved sealing arrangement in which the build up of excessive water vapor pressure can be relieved while minimizing any tendency to increase the sogginess of any of the foods.

SUMMARY OF THE INVENTION

The radiation transparent, compartmented trays are of inexpensive plastic molded construction and typically contain the component foods of the meal in its compartments, the foods having been precooked and then frozen or refrigerated in the tray. The tray configuration includes a bottom wall, an upstanding peripheral side wall and a number of ridges formed integrally and extending up from the bottom wall to define the compartments. The compartments are sealed by a radiation transparent plastic film which extends over the top of the tray and which is heat sealed or otherwise suitably bonded to the upper edge of the ridges and tray side wall. In one embodiment of the invention selected tray compartments, such as those which would receive a component food having a high water content, (e.g. meat, starch or vegetable) have a weakened seal portion between the plastic cover and the upper edge of the side wall. The weakened region of the seal is designed so that in the event that excessive water vapor pressure builds up in the particular compartment the seal will rupture to enabling the excess moisture to be vented outside of the tray. The seal is designed to define the weakest portion surrounding the particular compartment to insure that the other regions of the seal which are adjacent other food-filled compartments will not break.

In another embodiment of the invention in which the tray is specifically designed for use with a microwave oven and a shielding box into which the tray is inserted through an open side thereof, it is desirable to vent the excess moisture out through the opening in the shielding box to prevent water vapor from condensing and collecting interiorly of the box at relatively inaccessible places. In this arrangement the ridges separating selected tray compartments have a notch at their upper edge which maintains communication between selected compartments. A number of such compartments are in sequential communication with each other with the last compartment in the sequence being exposed at the end of the tray which is exposed at the open end of the shielding box. The seal between the last compartment in the sequence and the side wall is weakened so that when excessive vapor pressure builds up within the sequentially communicated compartments the seal will rupture to vent simultaneously all of the compartments except those which are not in the sequene.

In the description of my invention, the term "heat-conditioning" will be used to define generally the application of heat to the extent necessary for the particular food product being heated. In this regard, it may be noted that the invention comtemplates that the food components usually will be precooked and frozen or refrigerated until subsequent use. Such foods are preferably slightly undercooked so that when heated to the proper serving temperature, the added heat may complete the cooking process. In some instances, however, the food may not have been frozen and will require a different degree of heating in order to bring it to the proper serving temperature. The term "heat-conditioning" is intended to embrace these or other techniques for heating the food to the proper extent which, in turn, intends on the type of food and its condition before insertion into the radiant energy oven.

It is among the primary objects of the invention to provide a prepackaged meal in a compartmented tray for subsequent heat-conditioning in which any tendency for selected of the foods to become soggy is minimized.

A further object of the invention is to provide an improved prepackaged food tray having self-operable venting means to enable excessive water vapor to be vented to the atmosphere.

A further object of the invention is to provide an improved prepackaged food tray having self-operable venting means to enable excessive water vapor to be vented to the atmosphere.

A further object of the invention is to provide an improved prepackaged food tray in which excessive water vapor in selected compartments of the tray may be vented in response to the build up of water vapor pressure beyond a predetermined magnitude.

A further object of the invention is to provide an improved prepackaged multiple food component meal of the type described in which the water vapor is vented from selected tray compartments directly to the atmosphere.

Still another object of the invention is to provide a prepackaged meal and tray therefor in which a plurality of the tray compartments are in sequential communication with each other and in which the last tray compartment in the sequence is self-operable to vent the communicating compartments to the atmosphere.

DESCRIPTION OF THE DRAWINGS

The foregoing and other objects and advantages of the invention will be understood more fully from the following further description thereof, with reference to the accompanying drawings wherein.

DESCRIPTION OF THE PREFERRED EMBODIMENT

Figure 1:
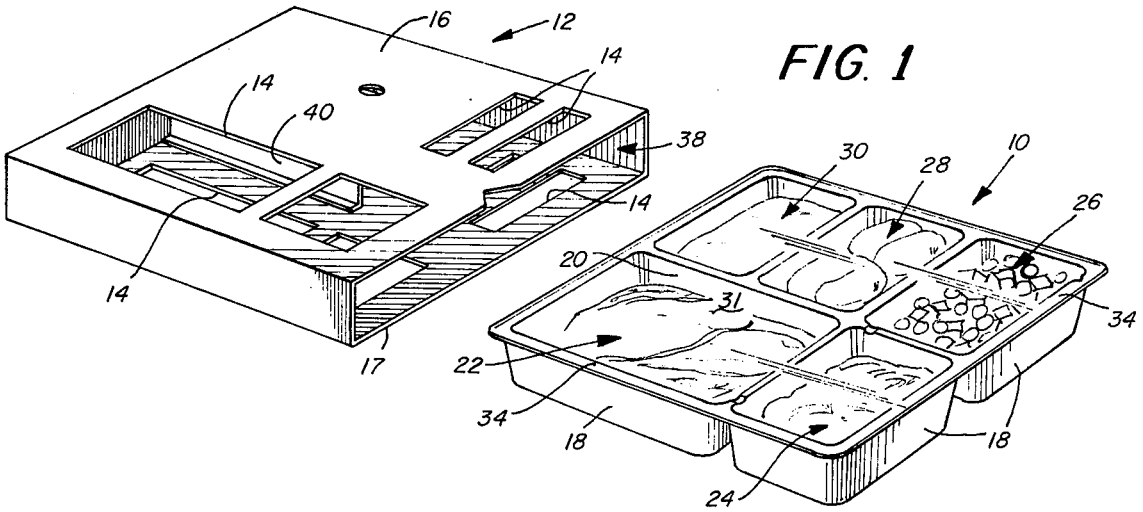
FIG. 1 is an illustration of a frozen or refrigerated packaged meal and a shielding box receptive to the tray to control the extent of heat-conditioning radiation to which the tray is exposed but in a radiant energy oven.

FIG. 1 shows, generally, the type of compartmented tray 10 and the manner in which it is employed to control the heat-conditioning of the food carried therein, by inserting the tray 10 into a metallic shielding box 12 which is opaque to radiant energy, such as microwave energy except for apertures 14 formed on the top and bottom walls 16, 17. The apertures 14 define radiation transparent windows and are of a size and configuration in relation to the tray compartments and foods therein to control to extent of exposure of the individual foods to the radiant energy. Reference is made to U.S. Pat. No. 3,547,661 for a general description of the manner in which the heating of the food is selectively controlled.

The improved tray is shown more fully in FIGS. 2-6. It is formed from a material transparent to electromagnetic radiation and particularly to microwave energy. The tray is formed from an easily moldable inexpensive plastic such as styrene or the like and includes a bottom wall, an upstanding peripheral side wall 18 and a number of interior upstanding ridges 20. The bottom wall, side wall 18 and ridges 20 and arranged to define a plurality of compartments 22, 24, 26, 28 and 30 which are intended to hold different component foods of the meal such as meat, potatoes, vegetables, rolls and a cold dessert, respectively.

The trays are filled with the desired component foods comprising the complete meal and are frozen or refrigerated directly in the tray for subsequent use. The tray is covered with an appropriate protective cover 31 which is effective to seal the food within the tray and to isolate the tray compartments from each other. The cover is in the form of a radiation transparent film and preferably is also optically transparent. It may be made from plastic which is heat sealed to the peripheral rim 34 at the upper edge of the side wall 18 and the upper surface of ridges. The isolation of the component foods in the distinct compartments is desirable so that during the heat-conditioning process the vapors and/or odors of individual foods, which may vary widely in character, will not be exposed to each other. As mentioned above this might result in migration of water vapor from one of the more water bearing foods to one of the other foods in the other compartments and impart a soggy consistency to that other food. For example, if the compartment 28 which contains the bread or roll were exposed to any of the compartments 22, 24 or 26 which have meat, starch or vegetable, the roll might become soggy by the time the meal has been fully heat-conditioned. Further, if hot water vapor leaked into the ice cream compartment 30 the ice cream obviously would lose its intended consistency.

While a simple heat seal of the plastic film to the upper edges of the ridges and side wall ordinarily is adequate to isolate the component foods during heat-conditioning there may be some instances in which the seal between the film 31 and the upper edge of a ridge between adjacent compartments may weaken and rupture during heat-conditioning. This may occur if the water vapor give off by one or more of the foods reached a pressure sufficient to break that seal.

In order to avoid inadvertent leakage of water vapor into selected tray compartments, such as compartments 28, 30, the seal between the other compartments which bear water laden foods, is weakened so that in the event of excess pressure build up from water vapor the seal will rupture at its weakened portion to vent those compartments to the atmosphere. As shown in FIGS. 2-6, the portion of the side wall 18 defining the vegetable compartment 26 defines a depression or notch 32 which effectively reduces the width of the seal between the sealed peripheral margin of the transparent film 31 and the rim 34 of the tray at the upper edge of the side wall 18 (See FIG. 6). The width of the seal at this region is substantially less than the width of the seal between the upper surfaces of the ridges defining the compartments to be selectively isolated such as compartments 28, 30 so that, should the vapor pressure in compartment 26 build up excessively, the seal at the notched region of the rim 34 will rupture thus venting the compartment 26 and enabling water vapor therein to be exhausted. Water vapor from the compartments 22, 24 also may be vented in sequence through the compartment 26 by means of depressions 36 formed in the upper edge of the ridges separating the compartments 22, 24 and 24, 26. Because each of the ventable compartments 22, 24 and 26 all contain food components having significant water content, the exposure of migrating water vapor from the compartment 22 and 24 through the compartment 26 will have no substantially adverse affect on the consistency of those sequentially oriented foods.

Figure 2:
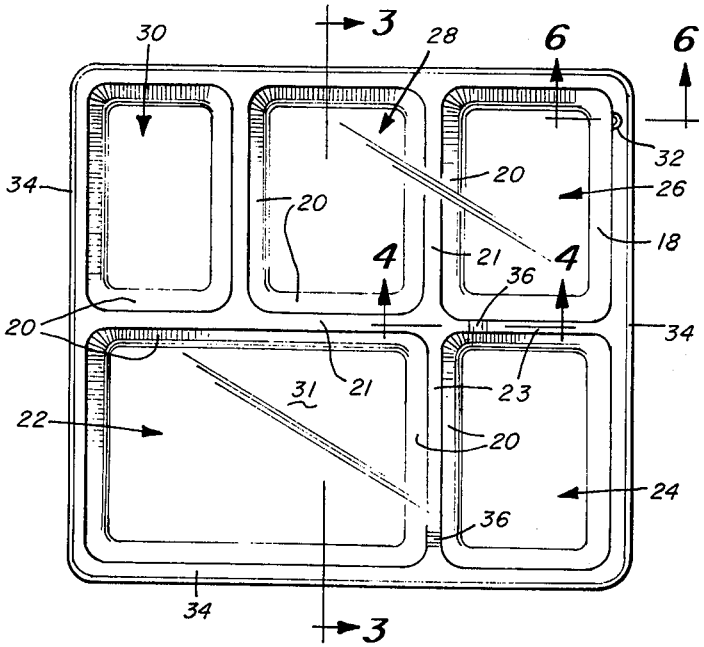
FIG. 2 is a plan view of the tray.
Figure 3:
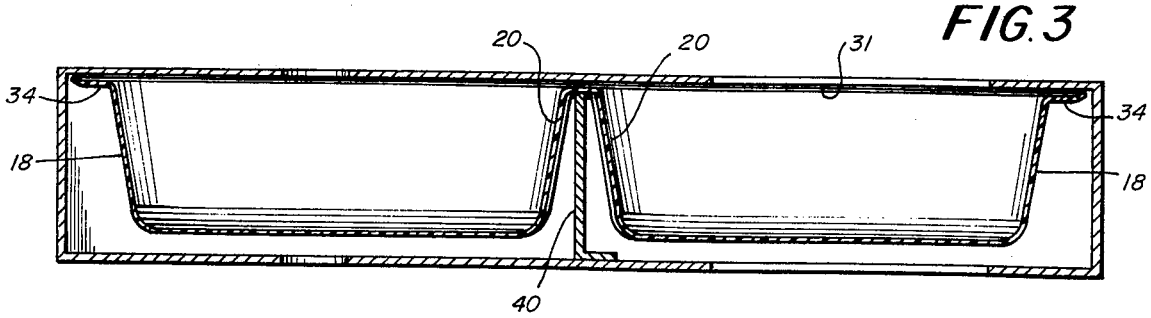
FIG. 3 is a sectional elevation of the tray when in the shielding box as seen along the line 3—3 of FIG. 2.
Figure 4:
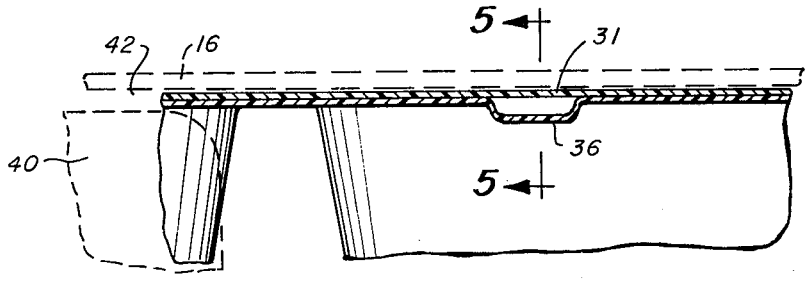
FIG. 4 is a sectional elevation of a portion of the tray as seen along the line 4—4 of FIG. 2 and with portion of the shielding box suggested in phantom.
Figure 5:
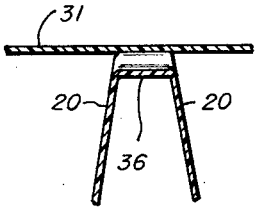
FIG. 5 is an illustration of a portion of the tray as seen along the line 5—5 of FIG. 4.
Figure 6:
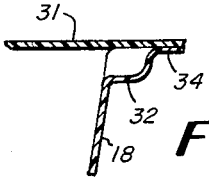
FIG. 6 is an illustration of a portion of the tray as seen along the line 6—6 of FIG. 2.

The isolation of the water bearing ventable food compartments 22, 24, 26 from the other compartments 28, 30 may be enhanced further by forming the upper surfaces of the ridges 20 which separate the two groups of compartments to define broadened areas to which the film may be sealed. For example, as shown in FIG. 2 the upper surfaces of the ridges 20 may be flat and the surfaces indicated at 21 may be of enlarged area, as compared to the surfaces 23 of other ridges of the tray.

The embodiment of the invention described above is particularly useful with the type of shielding box shown in FIG. 1 in which it is desirable to avoid condensation of water within the interior, relatively inaccessible portions of the shielding box 12. When used with such a shielding box the vent notch 32 should be located on the tray so that it is exposed outwardly through that portion of the box in which opening 38 is formed to receive the tray. This insures that vented water vapor will not condense inside the shielding box. In order to insure that the tray 10 is inserted into the shielding box 12 in the proper orientation, so that the vent notch 32 will be located at the box opening 38, the interior of the box preferably includes a guide member 40 which is disposed within the box and which is formed in relation to the tray to permit full insertion of the tray 10 into the box 12 only in the proper orientation. This also insures that the tray compartments will be properly registered with the intended apertures 14 in the walls of the shielding box 12. To this end, in the embodiment shown, the guide member 40 is secured to the bottom wall 17 of the box 12 and extends upwardly toward the top wall 16 of the box, leaving a slight clearance 42 therebetween (see FIG. 4). The space 42 between the upper edge of the guide member 40 and top wall 16 of the box 12 is slightly larger than the thickness of the sheet plastic from which the tray is formed but is not as large as the depth of the depression 36. The depression 36 is located on the tray so that if the tray is inserted backwards, e.g., with the notch portion 32 exposed within the interior of the box 12, the depression 36 would become caught between the guide member 40 and top wall 16 of the box thus resisting full and further insertion of the tray into the box. It would then be readily apparent to the user that the tray had been inserted improperly and that it should be removed and reinserted.

Figure 7:
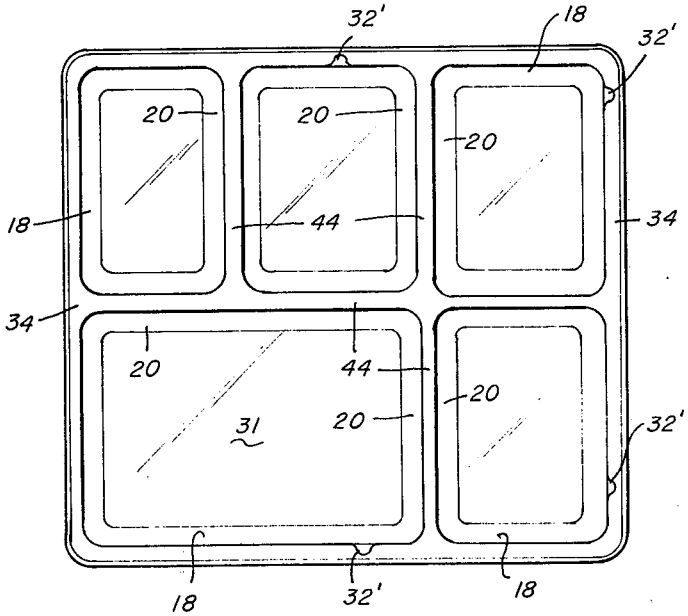
FIG. 7 is an illustration of a modification of the tray in which each of the selected vented compartments vent independently and directly to the atmosphere.

FIG. 7 shows a further embodiment of the invention which is more adapted for use with other types of shielding arrangements in which collection of condensed water interiorly of the shielding box is less of a consideration. In this embodiment the intercompartment communicating depressions 36 are eliminated and the plastic film 31 is sealed completely and fully to all of the upper surfaces 44, ridges and rim 34. The compartments bearing the water laden food may be each individually vented to the atmosphere by forming a portion of the side wall 18 and adjacent rim 34 defining each of those compartments to include a separate notch 32. The width of the seal defined at each notch 32 should be substantially less than the width of the seal defined between the plastic film 31 and any of the upper edges 44 of the ridges 20.

It should be understood that the foregoing description of the invention is intended merely to be illustrative thereof and that other modifications and embodiments may be apparent to those skilled in the art without departing from its spirit.

Having thus described the invention what I desire to claim and secure by Letters Patent is:

1. A package comprising:

a tray formed from a material transparent to electromagnetic radiation, said tray having a bottom wall, a peripheral upstanding side wall and ridge means extending upwardly from the bottom wall and cooperative with said bottom wall and said peripheral side wall to define a plurality of at least three compartments;

said compartments each containing a food component, at least two, but less than all of said compartments containing food components which will give off water vapor when heat conditioned, said at least two, but less than all of said compartments defining ventable compartments;

a radiation transparent cover extending over said tray and being sealed to the upper edge of said ridge means and said peripheral side wall to isolate said compartments from each other;

means communicating said ventable compartments with each other to permit communication of said water vapor from one of said ventable compartments to the other of said ventable compartments; and at least one portion of the seal between said cover and said peripheral wall associated with a selected one of said ventable compartments being constructed to be weaker than the other portions of said seal, said one portion of the seal being sufficiently weak as to rupture in response to build up of water vapor pressure in said ventable compartments beyond a predetermined magnitude whereby the water vapor generated in each of said ventable compartments may vent, sequentially, through said ventable compartments and through the ruptured seal in a predetermined direction.

2. A package as defined in claim 1 wherein said means communicating said ventable compartments comprises:

that portion of said ridge means common to said ventable compartments having a depression formed at the upper edge thereof, and being attached to the upper edge of the ridge means, said depression and said cover defining an opening communicating said compartments.

3. A package as defined in claim 1 further comprising:

the upper edge of the peripheral side wall having a rim, the radiation transparent cover being fused to the rim along a seal line which is of a predetermined width;

said seal having a fused region which is of less width than the remaining portions of said seal thereby defining a weakened region.

4. A package as defined in claim 2 wherein said lesser width of said seal between said cover and said rim is defined by means comprising:

a notch formed in said rim said cover being free of any seal to said notched region.

5. A device for use in heat-conditioning a prepared meal by microwave energy comprising:

a tray formed from a material transparent to microwave radiation, said tray having a bottom wall, a peripheral upstanding side wall and ridge means extending upwardly from the bottom wall and cooperative with said bottom wall and said peripheral side wall to define a plurality of at least three compartments;

said compartments each containing a food component, at least two, but less than all of said compartments containing food components which will give off water vapor when heat conditioned said at least two, but less than all of said compartments defining ventable compartments;

a radiation transparent cover extending over said tray and being sealed to the upper edge of said ridge means and said peripheral side wall to isolate said compartments from each other;

means communicating said ventable compartments with each other to permit communication of said water vapor from one of said ventable compartments to the other of said ventable compartments;

at least one portion of the seal between said cover and said peripheral wall associated with one of said ventable compartments being constructed to be weaker than the other portions of said seal, said one portion of the seal being sufficiently weak as to rupture in response to build up of water vapor pressure in said ventable compartments beyond a predetermined magnitude whereby the water vapor generated in each of said ventable compartments may vent, sequentially, through said ventable compartments and through the ruptured seal;

a shielding box formed from a material which is opaque to said microwave energy, said shielding box having an opening therein to removably receive said tray, said shielding box having aperture means formed in the walls thereof to selectively control the degree of exposure of foods within said tray compartments to microwave energy when said tray is in a predetermined orientation within said shielding box;

registration means on said shielding box and said tray to enable insertion of said tray into said box only in said predetermined orientation; and said weak portion of said seal being located at that portion of said side wall of said tray which is exposed through said opening in said shielding box when said tray is in said predetermined orientation in said box, whereby said ventable compartments may be vented in a direction extending through the opening of the shielding box.

6. Apparatus as defined in claim 5 wherein said registration means comprises:

a guide member secured to said shielding box internally thereof, said guide member being cooperative with a wall of said shielding box to define an opening of predetermined width;

said tray being constructed so that a ridge thereof may receive said guide member when said tray is inserted into said shielding box; and means forming a depression by the upper surface of said ridge to communicate the tray compartments defined by said ridge, said depression being of a depth which is greater than the dimensions of said opening between said guide member and said wall of said shielding box, said depression being formed on said ridge as to enable full insertion of said tray into said box only in said predetermined attitude.

* * * * *